US009810218B2

(12) United States Patent
McSweeney et al.

(10) Patent No.: US 9,810,218 B2
(45) **Date of Patent: *Nov. 7, 2017**

(54) CRANKCASE HEATER SYSTEMS AND METHODS FOR VARIABLE SPEED COMPRESSORS

(71) Applicant: Emerson Climate Technologies, Inc., Sidney, OH (US)

(72) Inventors: Daniel L. McSweeney, Sidney, OH (US); Charles E. Green, Fenton, MO (US); Stephen M. Seibel, Celina, OH (US)

(73) Assignee: Emerson Climate Technologies, Sidney, OH (US)

( * ) Notice: Subject to any disclaimer, the term of this patent is extended or adjusted under 35 U.S.C. 154(b) by 513 days.

This patent is subject to a terminal disclaimer.

(21) Appl. No.: 14/286,132

(22) Filed: May 23, 2014

(65) Prior Publication Data

US 2014/0255209 A1 Sep. 11, 2014

Related U.S. Application Data

(63) Continuation of application No. 12/888,823, filed on Sep. 23, 2010, now Pat. No. 8,734,125.
(Continued)

(51) Int. Cl.
*F25B 49/02* (2006.01)
*F04C 29/04* (2006.01)
(Continued)

(52) U.S. Cl.
CPC ..... *F04C 28/28* (2013.01); *F04B 35/04* (2013.01); *F04C 29/045* (2013.01);
(Continued)

(58) Field of Classification Search
CPC F25B 29/022; F25B 29/025; F25B 2600/021; F25B 2600/024; F25B 2400/01;
(Continued)

(56) References Cited

U.S. PATENT DOCUMENTS 2,107,887 A 2/1938 Davenport
3,133,429 A 5/1964 Griffin
(Continued)

FOREIGN PATENT DOCUMENTS

CN 1391060 A 1/2003
CN 101319818 A 12/2008
(Continued)

OTHER PUBLICATIONS

Examiner-Initiated Interview Summary regarding U.S. Appl. No. 14/079,271, dated Sep. 16, 2015.
(Continued)

*Primary Examiner* — Peter J Bertheaud
(74) *Attorney, Agent, or Firm* — Harness, Dickey & Pierce, P.L.C.

(57) ABSTRACT

A system includes a compressor having a shell housing a compression mechanism driven by an electric motor in an on state and not driven by the electric motor in an off state. The system also includes a variable frequency drive that drives the electric motor in the on state by varying a frequency of a voltage delivered to the electric motor and that supplies electric current to a stator of the electric motor in the off state to heat the compressor.

20 Claims, 8 Drawing Sheets

Related U.S. Application Data

(60) Provisional application No. 61/245,394, filed on Sep. 24, 2009.

(51) Int. Cl.
*F04B 39/06* (2006.01)
*F04C 28/28* (2006.01)
*F04B 35/04* (2006.01)
*F04C 18/02* (2006.01)

(52) U.S. Cl.
CPC ..... *F25B 49/022* (2013.01); *F04B 39/06* (2013.01); *F04C 18/0215* (2013.01); *F04C 29/04* (2013.01); *F04C 2240/81* (2013.01); *F04C 2270/195* (2013.01); *F04C 2270/701* (2013.01); *F25B 2600/021* (2013.01)

(58) Field of Classification Search
CPC ..... F25B 2700/2115; F04C 2270/19; F04C 2270/195; F04C 29/04; F04B 39/06; F04B 2203/0205
USPC ..... 417/32, 44.1, 45
See application file for complete search history.

(56) References Cited

U.S. PATENT DOCUMENTS

| | | | | |
|---|---|---|---|---|
| 3,208,237 | A | 9/1965 | Gerteis | |
| 3,237,848 | A * | 3/1966 | Pihl | F25B 31/02 318/473 |
| 3,577,741 | A | 5/1971 | Shaw | |
| 3,705,499 | A | 12/1972 | Mount et al. | |
| 4,066,869 | A | 1/1978 | Apaloo et al. | |
| 4,208,883 | A | 6/1980 | Stirling | |
| 4,236,379 | A | 12/1980 | Mueller | |
| 4,275,570 | A | 6/1981 | Szymaszek et al. | |
| 4,444,017 | A | 4/1984 | Briccetti et al. | |
| 4,490,988 | A | 1/1985 | Vogel et al. | |
| 4,506,519 | A | 3/1985 | Morse et al. | |
| 4,605,831 | A | 8/1986 | Mitchell | |
| 4,638,643 | A * | 1/1987 | Sakazume | F25B 49/025 318/436 |
| 5,012,652 | A | 5/1991 | Dudley | |
| 5,052,897 | A | 10/1991 | Yamashita et al. | |
| 5,054,293 | A | 10/1991 | Schwecke | |
| 5,062,217 | A | 11/1991 | Tolson | |
| 5,230,222 | A | 7/1993 | Erbs | |
| 5,252,036 | A | 10/1993 | Bunch et al. | |
| 5,369,958 | A | 12/1994 | Kasai et al. | |
| 5,577,390 | A | 11/1996 | Kaido et al. | |
| 6,523,361 | B2 | 2/2003 | Higashiyama | |
| 6,591,621 | B2 | 7/2003 | Loprete et al. | |
| 6,617,819 | B2 * | 9/2003 | Dohmae | F24F 11/008 318/436 |
| 6,642,682 | B1 * | 11/2003 | Perkins | G05D 23/1919 318/436 |
| 6,834,513 | B2 | 12/2004 | O'Brien et al. | |
| 6,848,268 | B1 | 2/2005 | Memory et al. | |
| 6,886,354 | B2 * | 5/2005 | Dudley | F04B 39/0207 417/13 |
| 6,904,759 | B2 | 6/2005 | Shoulders | |
| 7,096,681 | B2 | 8/2006 | Wills et al. | |
| 7,290,990 | B2 | 11/2007 | Lifson | |
| 7,331,187 | B2 | 2/2008 | Kates | |
| 7,797,084 | B2 | 9/2010 | Miwa | |
| 8,616,855 | B2 * | 12/2013 | Burchill | F04B 49/02 318/436 |
| 8,734,125 | B2 * | 5/2014 | McSweeney | F04B 35/04 417/228 |
| 9,551,357 | B2 | 1/2017 | Waller | |
| 2002/0018724 | A1 | 2/2002 | Millet et al. | |
| 2002/0020175 | A1 | 2/2002 | Street et al. | |
| 2002/0129612 | A1 | 9/2002 | Saikusa et al. | |
| 2002/0157408 | A1 * | 10/2002 | Egawa | F25B 49/025 62/228.1 |
| 2003/0213256 | A1 | 11/2003 | Ueda et al. | |
| 2004/0068387 | A1 | 4/2004 | Bonanni et al. | |
| 2004/0083731 | A1 | 5/2004 | Lasker | |
| 2004/0194485 | A1 | 10/2004 | Dudley | |
| 2004/0211193 | A1 | 10/2004 | Van der Walt et al. | |
| 2005/0126171 | A1 | 6/2005 | Lasker | |
| 2005/0188708 | A1 | 9/2005 | Wills et al. | |
| 2005/0248456 | A1 | 11/2005 | Britton et al. | |
| 2006/0070398 | A1 | 4/2006 | De Bernardi et al. | |
| 2006/0196206 | A1 | 9/2006 | Murray et al. | |
| 2007/0006608 | A1 | 1/2007 | Lee | |
| 2008/0245083 | A1 | 10/2008 | Tutunoglu et al. | |
| 2009/0324427 | A1 | 12/2009 | Tolbert, Jr. et al. | |
| 2010/0254834 | A1 | 10/2010 | Tolbert, Jr. | |
| 2010/0278660 | A1 | 11/2010 | Burchill et al. | |
| 2011/0070100 | A1 | 3/2011 | McSweeney et al. | |
| 2011/0083450 | A1 | 4/2011 | Turner et al. | |
| 2012/0227430 | A1 | 9/2012 | Takeuchi et al. | |
| 2013/0045113 | A1 | 2/2013 | Foye et al. | |
| 2013/0115063 | A1 | 5/2013 | Waller | |
| 2014/0138451 | A1 | 5/2014 | Pham | |
| 2015/0075205 | A1 | 3/2015 | Ramayya | |

FOREIGN PATENT DOCUMENTS

| | | | |
|---|---|---|---|
| CN | 101392745 | A | 3/2009 |
| EP | 0546982 | A1 | 6/1993 |
| JP | 6116278 | | 1/1986 |
| JP | 10009685 | | 1/1998 |
| WO | 2009095989 | A1 | 8/2009 |
| WO | 2009096620 | A1 | 8/2009 |
| WO | 2009096923 | A1 | 8/2009 |
| WO | 2012125891 | A2 | 9/2012 |

OTHER PUBLICATIONS

Office Action regarding Chinese Patent Application No. 201410545027.9, dated Jan. 28, 2016. Translation provided by Unitalen Attorneys at Law.

Office Action regarding U.S. Appl. No. 13/664,805, dated Feb. 19, 2016.

Notice of Allowance and Fees Due regarding U.S. Appl. No. 14/461,796, dated Apr. 1, 2016.

Extended European Search Report regarding Application No. 12187632.0-1602 / 2589898, dated Dec. 13, 2013.

First Chinese Office Action regarding Application No. 201210436480.7, dated Dec. 26, 2014. Translation obtained from espacenet.com.

International Search Report regarding Application No. PCT/US2013/070082, dated Feb. 20, 2014.

International Search Report regarding Application No. PCT/US2014/056120, dated Dec. 17, 2014.

Non-Final Office Action regarding U.S. Appl. No. 13/664,805, dated May 8, 2015.

Written Opinion of the International Searching Authority for PCT/US2013/070082, dated Feb. 20, 2014.

Written Opinion of the International Searching Authority regarding Application No. PCT/US2014/056120, dated Dec. 17, 2014.

First Office Action and Search Report from State Intellectual Property Office of People's Republic of China regarding Chinese Patent Application No. 201080042651.7, dated Jan. 15, 2014. Translation provided by Unitalen at Law.

International Search Report regarding Application No. PCT/US2010/050109, dated May 3, 2011.

Non-Final Office Action regarding U.S. Appl. No. 12/888,823, dated Jun. 11, 2013.

Written Opinion of International Searching Authority regarding Application No. PCT/US2013/070082, dated Feb. 20, 2014.

Written Opinion of the International Searching Authority regarding Application No. PCT/US2010/050109, dated May 3, 2011.

Office Action regarding U.S. Appl. No. 14/936,117, dated May 3, 2017.

(56) References Cited

OTHER PUBLICATIONS

Search Report regarding European Patent Application No. 10819499.4, dated Apr. 13, 2017.
Search Report regarding European Patent Application No. 14846356.5, dated Apr. 10, 2017.

* cited by examiner

CRANKCASE HEATER SYSTEMS AND METHODS FOR VARIABLE SPEED COMPRESSORS

CROSS-REFERENCE TO RELATED APPLICATIONS

This application is a continuation of U.S. patent application Ser. No. 12/888,823, filed on Sep. 23, 2010, now U.S. Pat. No. 8,734,125, which claims the benefit of U.S. Provisional Application No. 61/245,394, filed on Sep. 24, 2009. The entire disclosures of the above applications are incorporated herein by reference.

FIELD

The present disclosure relates to compressors, and more particularly to heater systems and methods for use with a variable speed compressor.

BACKGROUND

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

Compressors may be used in a wide variety of industrial and residential applications to circulate refrigerant within a refrigeration, heat pump, HVAC, or chiller system (generically "refrigeration systems") to provide a desired heating or cooling effect. In any of the foregoing applications, the compressor should provide consistent and efficient operation to insure that the particular application (i.e., refrigeration, heat pump, HVAC, or chiller system) functions properly. A variable speed compressor may be used to vary compressor capacity according to refrigeration system load.

Compressors may include crankcases to house moving parts of the compressor, such as a crankshaft. Crankcases may further include lubricant sumps, such as an oil reservoir. The lubricant sumps include lubricants that lubricate the moving parts of compressors. Lubrication of the compressors may improve performance and/or prevent damage.

Lubricants in the crankcases may cool to low temperatures when the compressor is not running. For example, the crankcases may cool due to a low outdoor ambient temperature. Additionally, lubricants may cool due to liquid refrigerant that returns to the compressor during the running cycle, otherwise known as "liquid flood-back."

Lubricant properties may change at low temperatures. More specifically, lubricants may become more viscous (i.e., thicker) at low temperatures. Thus, starting a compressor with a low temperature crankcase (i.e., cold lubricant), otherwise known as a "cold start," may result in damage to the compressor and/or decreased performance due to insufficient lubrication. In addition, liquid refrigerant may enter the compressor when the compressor is on or off. The liquid refrigerant may also change properties of the lubricant. Therefore, compressors may include heating elements to heat the crankcase (and in turn the refrigerant and lubricant) in order to avoid problems related to "cold starting."

SUMMARY

A system includes a compressor including a shell housing a compression mechanism driven by an electric motor in an on state and not driven by the electric motor in an off state. The system also includes a variable frequency drive that drives the electric motor in the on state by varying a frequency of a voltage delivered to the electric motor and that supplies electric current to a stator of the electric motor in the off state to heat the compressor.

In other features, the system may include a control module connected to the variable frequency drive that controls a speed of the electric motor in the on state and that controls the electric current supplied to the stator of the electric motor in the off state.

In other features, the system may include a temperature sensor that generates a temperature signal corresponding to a temperature of the compressor. The control module may receive the temperature signal and control the electric current supplied to the stator of the electric motor in the off state to maintain the temperature of the compressor above a predetermined temperature threshold.

In other features, the temperature sensor may measure a temperature of a lubricant in a lubricant sump of the compressor.

In other features, the temperature sensor may measure a temperature of the compression mechanism.

In other features, the system may include a compressor temperature sensor that generates a compressor temperature signal corresponding to a compressor temperature and an ambient temperature sensor that generates an ambient temperature signal corresponding to an ambient temperature. The control module may receive the compressor temperature signal and the ambient temperature signal, determine a desired compressor temperature based on the ambient temperature, compare the compressor temperature with the desired compressor temperature, and determine an amount of electric current to supply to the stator in the off state based on the comparison.

In other features, the control module may determine the desired compressor temperature based on a sum of the ambient temperature and a predetermined temperature threshold.

In other features, the predetermined temperature threshold may be between ten and twenty degrees Fahrenheit.

In other features, the system may include a first temperature sensor that generates a first temperature signal corresponding to a compressor temperature and a second temperature sensor that generates a second temperature signal corresponding to at least one of a temperature of an inverter board of the variable frequency drive, a temperature of a power factor correction module of the variable frequency drive, and a suction tube temperature. The control module may receive the first and second temperature signals, determine a desired compressor temperature based on the second temperature, compare the compressor temperature with the desired compressor temperature, and determine an amount of electric current to supply to the stator in the off state based on the comparison.

In other features, the system may include a compressor temperature sensor that generates a compressor temperature signal corresponding to a compressor temperature. The stator may heat the compressor for a first time period and the control module may receive the compressor temperature signal, determine a rate of change of the compressor temperature over a second time period, after the first time period, and calculate an amount of current to supply to the stator based on the rate of change.

A method includes driving a compression mechanism of a compressor with an electric motor by driving the electric motor with a variable frequency drive that varies a frequency of a voltage delivered to the electric motor in an on state, and not driving the compression mechanism with the electric motor in an off state. The method also includes heating the compressor by supplying electric current to a stator of the electric motor with the variable frequency drive to heat the stator of the electric motor in the off state.

In other features, the method may include controlling a speed of the electric motor in the on state with a control module connected to the variable frequency drive and controlling, with the control module, the electric current supplied to the stator of the electric motor in the off state.

In other features, the method may include generating a temperature signal corresponding to a temperature of the compressor, receiving the temperature signal with the control module, and controlling, with the control module, the electric current supplied to the stator of the electric motor in the off state to maintain the temperature of the compressor above a predetermined temperature threshold.

In other features, the predetermined temperature threshold may be zero degrees Fahrenheit.

In other features, generating the temperature signal may include measuring a temperature of a lubricant in a lubricant sump of the compressor.

In other features, generating the temperature signal may include measuring a temperature of the compression mechanism.

In other features, the method may include generating a compressor temperature signal corresponding to a compressor temperature with a compressor temperature sensor, generating an ambient temperature signal corresponding to an ambient temperature with an ambient temperature sensor, receiving, with the control module, the compressor temperature signal and the ambient temperature signal, determining, with the control module, a desired compressor temperature based on the ambient temperature, comparing, with the control module, the compressor temperature with the desired compressor temperature, and determining, with the control module, an amount of electric current to supply to the stator of the electric motor in the off state based on the comparison.

In other features, determining the desired compressor temperature may be based on a sum of the ambient temperature and a predetermined temperature threshold.

In other features, the method may include generating a first temperature signal corresponding to a compressor temperature with a first temperature sensor, generating a second temperature signal corresponding to at least one of a temperature of an inverter board of the variable frequency drive, a temperature of a power factor correction module of the variable frequency drive, and a suction tube temperature, with a second temperature sensor, receiving the first and second temperature signals with the control module, determining, with the control module, a desired compressor temperature based on the second temperature, comparing, with the control module, the compressor temperature with the desired compressor temperature, and determining an amount of electric current to supply to the stator of the electric motor in the off state based on the comparison.

In other features, the method may include generating a compressor temperature signal corresponding to a compressor temperature with a compressor temperature sensor, heating the compressor with the stator for a first time period, receiving the compressor temperature signal with the control module, determining, with the control module, a rate of change of the compressor temperature over a second time period, after the first time period, and calculating, with the control module, an amount of current to supply to the stator of the electric motor based on the rate of change.

In still other features, the systems and methods described above are implemented by a computer program executed by one or more processors. The computer program can reside on a computer readable medium such as but not limited to memory, nonvolatile data storage, and/or other suitable tangible storage mediums.

Further areas of applicability will become apparent from the description provided herein. It should be understood that the description and specific examples are intended for purposes of illustration only and are not intended to limit the scope of the present disclosure.

BRIEF DESCRIPTION OF DRAWINGS

The present disclosure will become more fully understood from the detailed description and the accompanying drawings, wherein.

DETAILED DESCRIPTION

Figure 1A:
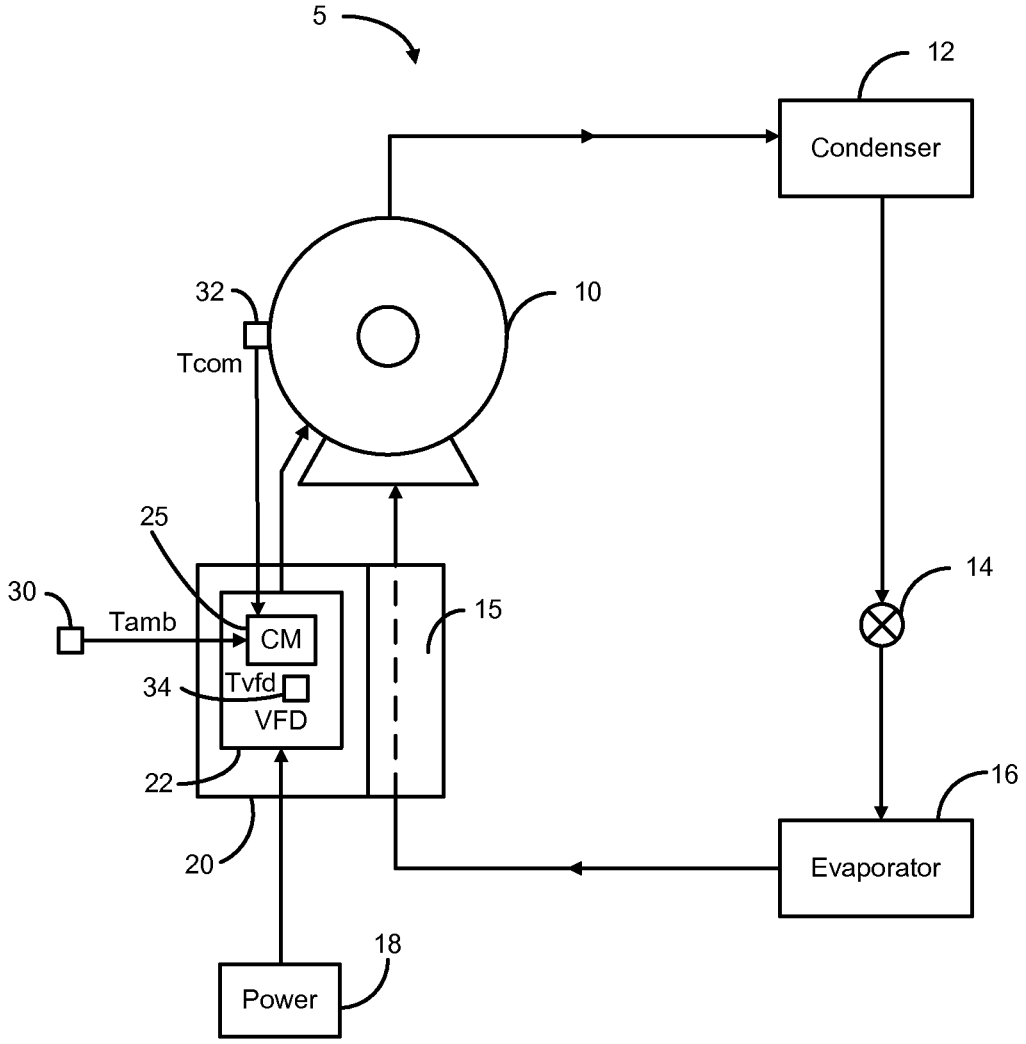
FIG. 1A is a schematic illustration of a first embodiment of a refrigeration system according to the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the terms module, control module, and controller may refer to, be part of, or include an Application Specific Integrated Circuit (ASIC), an electronic circuit, a processor (shared, dedicated, or group) and/or memory (shared, dedicated, or group) that execute one or more software or firmware programs, a combinational logic circuit, and/or other suitable components that provide the described functionality.

As used herein, computer readable medium may refer to any medium capable of storing data for a computer or module, including a processor. Computer-readable medium includes, but is not limited to, memory, RAM, ROM, PROM, EPROM, EEPROM, flash memory, CD-ROM, floppy disk, magnetic tape, other magnetic medium, optical medium, or any other device or medium capable of storing data for a computer.

Compressors may include heating elements that heat crankcases in order to avoid problems related to "cold starting" or "liquid flood-back." More specifically, heating the crankcases increases a temperature of lubricants inside the crankcases. Increasing the temperature of the lubricants may improve performance and/or prevent damage to the compressor due to the increased viscosity of cold lubricants.

Typical crankcase heating elements, hereinafter referred to as "crankcase heaters," may operate in different ways. For example, a crankcase heater may run continuously while the compressor is in an off state. Alternatively, a crankcase heater may run continuously while the compressor is in the off state and an ambient temperature is below a predetermined threshold. For example only, the predetermined threshold may be 70 degrees Fahrenheit. Additionally, a crankcase heater may run continuously after the compressor has been in the off state for a predetermined time. For example only, the predetermined time may be 30 minutes.

Typical crankcase heaters may run continuously when the compressor is in the off state and thus may heat the lubricants more than is required to avoid "cold starting." Therefore, typical crank case heaters may be inefficient due to wasted energy from excessive heating. Additionally, typical crankcase heaters may operate at a constant power. For example only, the constant power may be 40 watts. Therefore, typical crankcase heaters may take a very long time to heat the crankcase when the crankcase temperature is very low.

Thus, systems and methods for more efficient variable crankcase heaters are disclosed. The variable crankcase heaters may determine an amount of power to deliver to a compressor to maintain a desired temperature of lubricants inside the compressor. The variable amount of power required to maintain the desired temperature may be delivered to the compressor via a variable frequency drive (VFD). Furthermore, no additional heating element may be required.

The VFD may deliver the power to a stator in an electric motor of the compressor in an off state. The stator is a non-moving part of the electric motor in the compressor. For example, when the compressor is on the stator may magnetically drive a rotor that in turn drives a crankshaft. The crankshaft may, in turn, drive a compression mechanism of the compressor. However, when the compressor is in the off state, the stator may increase in temperature when supplied with current, and thus the stator may act as a heater for the lubricants inside the compressor.

The desired temperature of the lubricants may be a temperature to avoid "cold starting" and to ensure that any liquid refrigerant changes to a gaseous phase. For example only, the desired temperature of the lubricants may be 10 to 20 degrees Fahrenheit above an outdoor ambient temperature. Therefore, the variable crankcase heater may conserve energy by heating the lubricants as required to maintain the desired temperature.

The variable crankcase heater may also heat the lubricants faster via a larger power supply (e.g. more than 40 watts). In other words, the variable crankcase heater may run at a higher power than a typical crankcase heater, and thus may heat the crankcase faster. For example, faster crankcase heating may be desired when the compressor is at a very low temperature. Therefore, special start-up sequences to avoid "cold-starting" may no longer be required because the desired temperature may be constantly maintained. Additionally, lifetimes of compressor bearings may increase due to the avoidance of "cold starts."

Moreover, an upper temperature control limit may be implemented to prevent overheating of the VFD. More specifically, a temperature sensor may measure a temperature of an inverter module and the measured temperature may be used to detect overheating of the VFD. In other words, when overheating of the VFD is detected, power supplied to the motor may be decreased.

Figure 1B:
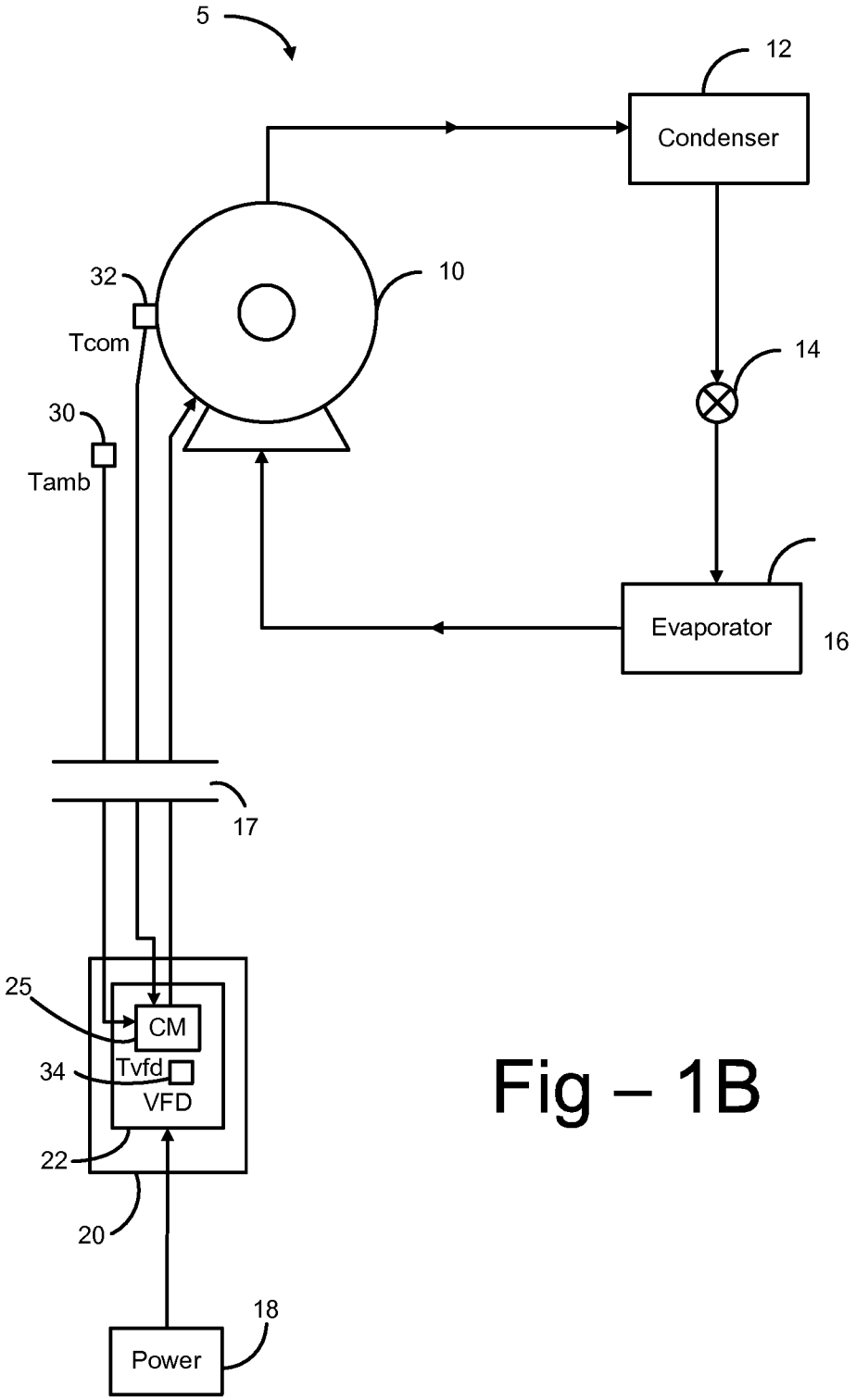
FIG. 1B is a schematic illustration of a second embodiment of a refrigeration system according to the present disclosure.

With reference to FIGS. 1A and 1B, an exemplary refrigeration system 5 includes a compressor 10 that includes a shell that houses a compression mechanism. In an on state, the compression mechanism is driven by an electric motor to compress refrigerant vapor. In an off state, the compression mechanism is not driven by the electric motor. In the exemplary refrigeration system 5 shown in the Figures, the compressor 10 is depicted as a scroll compressor and the compression mechanism may include a scroll having a pair of intermeshing scroll members, shown in FIG. 4. The present teachings, however, also apply to other types of compressor utilizing other types of compression mechanisms. For example, the compressor may be a reciprocating compressor and the compression mechanism may include at least one piston driven by a crank shaft for compressing refrigerant vapor. As another example, the compressor may be a rotary compressor and the compression mechanism may include a vane mechanism for compressing refrigerant vapor. Further, while a specific refrigeration system is shown in FIGS. 1A and 1B, the present teachings are applicable to any refrigeration system, including heat pump, HVAC, and chiller systems.

Refrigerant vapor from compressor 10 is delivered to a condenser 12 where the refrigerant vapor is liquefied at high pressure, thereby rejecting heat to the outside air. The liquid refrigerant exiting condenser 12 is delivered to an evaporator 16 through an expansion valve 14. Expansion valve 14 may be a mechanical, thermal, or electronic valve for controlling super heat of the refrigerant entering compressor 10.

The refrigerant passes through expansion valve 14 where a pressure drop causes the high pressure liquid refrigerant to achieve a lower pressure combination of liquid and vapor. As hot air moves across evaporator 16, the low pressure liquid turns into gas, thereby removing heat from the hot air adjacent the evaporator 16. The low pressure gas is again delivered to compressor 10 where it is compressed to a high pressure gas, and delivered to condenser 12 to start the refrigeration cycle again.

Figure 2:
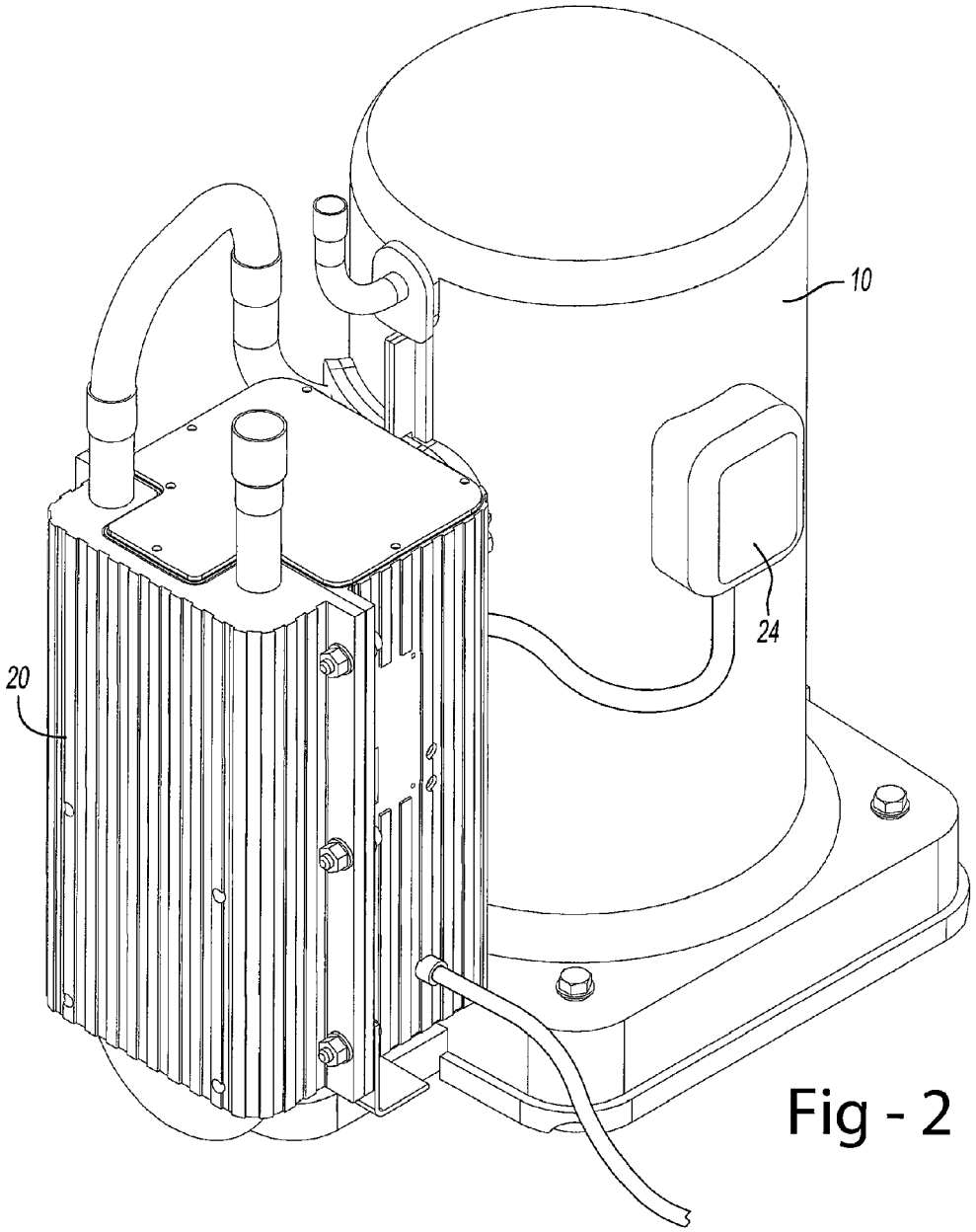
FIG. 2 is a perspective view of a compressor with a variable frequency drive according to the present disclosure.
Figure 3:
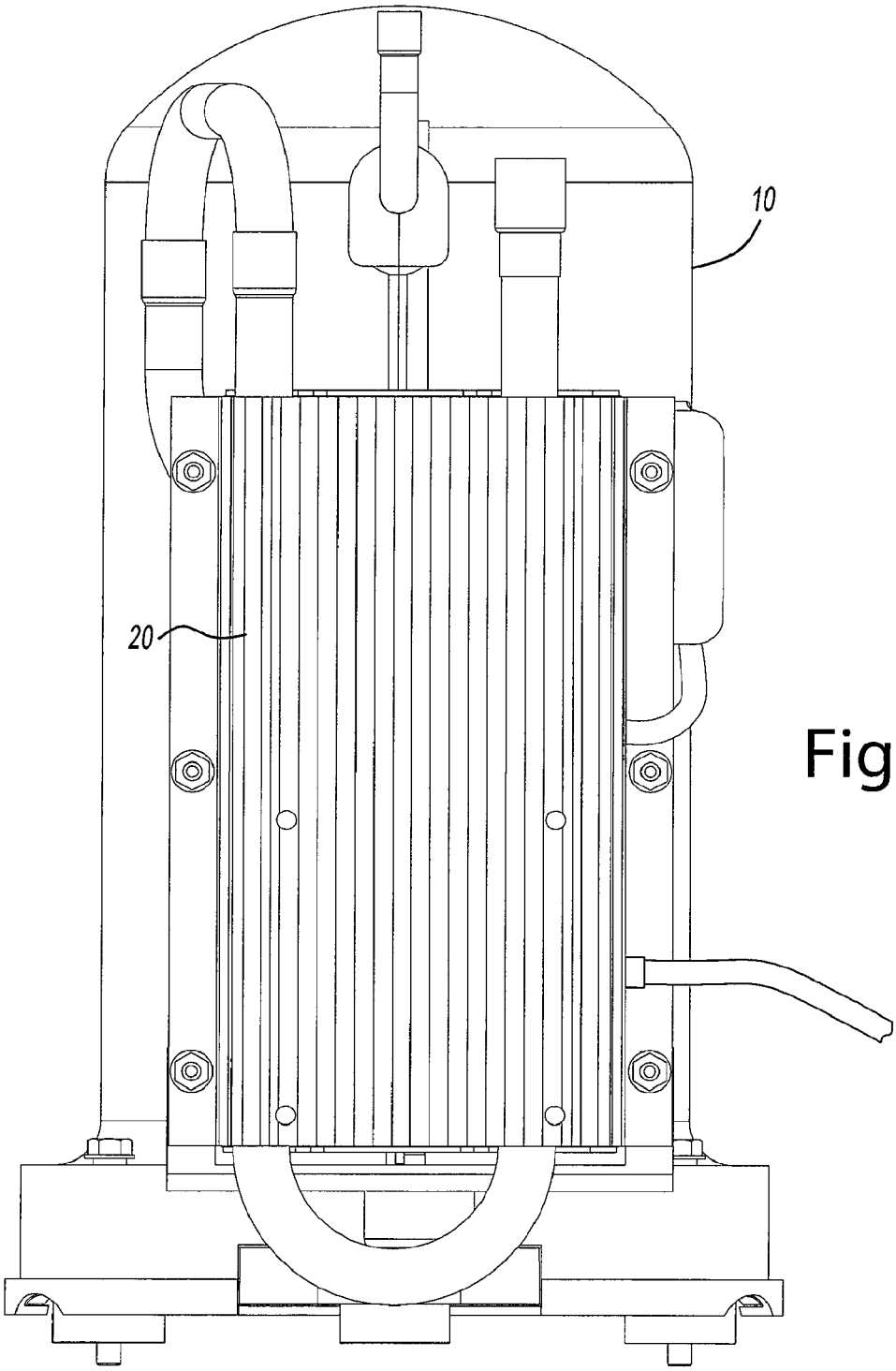
FIG. 3 is another perspective view of a compressor with a variable frequency drive according to the present disclosure.

With reference to FIGS. 1A, 1B, 2 and 3, compressor 10 may be driven by a variable frequency drive (VFD) 22, also referred to as an inverter drive, housed in an enclosure 20. Enclosure 20 may be near or away from compressor 10. Specifically, with reference to FIG. 1A, the VFD 22 is shown near the compressor 10. For example, as shown in FIGS. 2 and 3 the VFD 22 may be attached (as part of the enclosure 20) to the compressor 10. Alternatively, with reference to FIG. 1B, the VFD 22 may be located away from the compressor 10 by a separation 17. For example only, the separation 17 may include a wall. For example only, the VFD 22 may be located inside a building and the compressor 10 may be located outside of the building or in a different room than the compressor 10. Additionally, for example only, the separation 17 may be 10 meters.

VFD 22 receives an alternating current (AC) voltage from a power supply 18 and delivers AC voltage to compressor 10. VFD 22 may include a control module 25 with a processor and software operable to modulate and control the frequency and/or amplitude of the AC voltage delivered to an electric motor of compressor 10.

Control module 25 may include a computer readable medium for storing data including software executed by the processor to modulate and control the frequency and/or amplitude of voltage delivered to the compressor 10 and software necessary for control module 25 to execute and perform the heating and control algorithms of the present teachings. By modulating the frequency and/or amplitude of voltage delivered to the electric motor of compressor 10, control module 25 may thereby modulate and control the speed, and consequently the capacity, of compressor 10.

VFD 22 may include solid state electronics to modulate the frequency and/or amplitude of the AC voltage. Generally, VFD 22 converts the input AC voltage from AC to DC, and then converts the DC voltage from DC back to AC at a desired frequency and/or amplitude. For example, VFD 22 may directly rectify the AC voltage with a full-wave rectifier bridge. VFD 22 may then switch the voltage using insulated gate bipolar transistors (IGBT's) or thyristors to achieve the desired output (e.g., frequency, amplitude, current, and/or voltage). Other suitable electronic components may be used to modulate the frequency and/or amplitude of the AC voltage from power supply 18.

Piping from evaporator 16 to compressor 10 may be routed through enclosure 20 to cool the electronic components of VFD 22 within enclosure 20. Enclosure 20 may include a cold plate 15. Suction gas refrigerant may cool the cold plate prior to entering compressor 10 and thereby cool the electrical components of VFD 22. In this way, cold plate 15 may function as a heat exchanger between suction gas and VFD 22 such that heat from VFD 22 is transferred to suction gas prior to the suction gas entering compressor 10. However, as shown in FIG. 1B, the enclosure 20 may not include a cold plate 15 and thus the VFD 22 may not be cooled by suction gas refrigerant. For example, the VFD 22 may be air cooled by a fan. As a further example, the VFD 22 may be air cooled by the fan of the condenser 12, provided the VFD 22 and condenser 12 are located within sufficient proximity to each other.

As shown in FIGS. 2 and 3, voltage from VFD 22 housed within enclosure 20 may be delivered to compressor 10 via a terminal box 24 attached to compressor 10.

Figure 4:
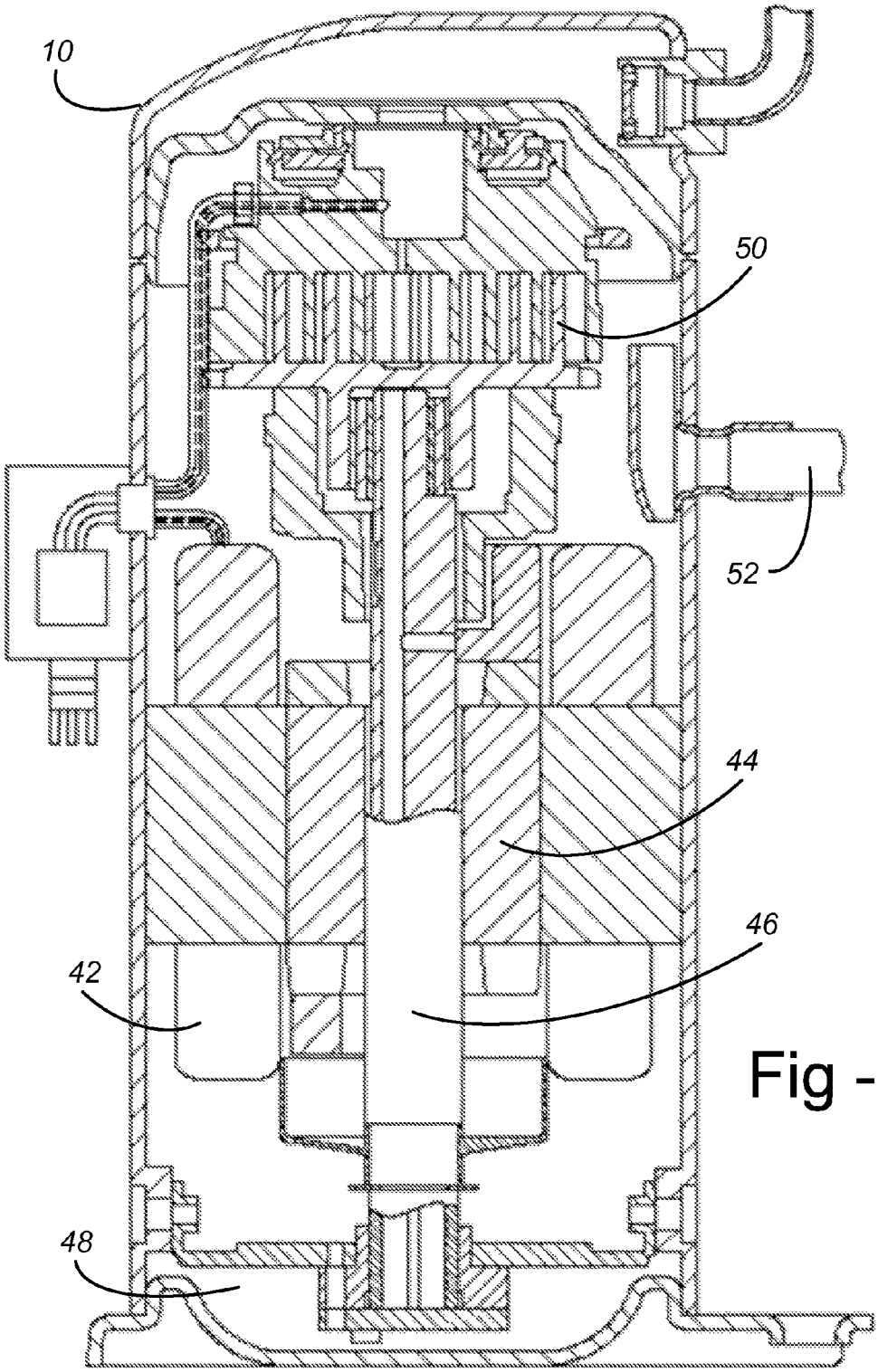
FIG. 4 is a cross-sectional view of a compressor according to the present disclosure.

With reference to FIG. 4, a cross-section of the compressor 10 is shown. The compressor 10 includes a stator 42 that magnetically turns a rotor 44 to drive a crankshaft 46 in an on state. A lubricant sump 48 includes lubricant (e.g. oil) that lubricates moving parts of the compressor 10 such as the crankshaft 46. The compressor 10 also includes a scroll 50 that is connected to the crankshaft 46. The crankshaft 46 drives the scroll 50 to compress refrigerant that is received through a suction tube 52.

With reference to FIGS. 1 and 4, the control module 25 may also control and modulate a temperature of the compressor 10. More specifically, the control module 25 may control and modulate a lubricant temperature in the lubricant sump 48 of the compressor 10. For example, the control module 25 may perform a closed-loop control of the lubricant temperature by supplying the stator 42 with current and by referencing one or more temperature sensors.

For example only, the plurality of temperature sensors may include an ambient temperature sensor 30, a compressor temperature sensor 32, and a VFD temperature sensor 34. The ambient temperature sensor 30 measures ambient temperature (Tamb) outside of the compressor 10 and/or the enclosure 20. For example only, the ambient temperature sensor 30 may be included as part of an existing system and thus available via a shared communication bus. However, a dedicated ambient temperature sensor 30 for the refrigeration system 5 may also be implemented.

The compressor temperature sensor 32 measures a temperature (Tcom) inside the compressor 10. For example, the compressor temperature sensor 32 may measure a temperature of the scroll 50. Additionally, the compressor temperature sensor 32 may measure a temperature in the lubricant sump 48 or a temperature of the stator 42. Furthermore, the temperature of the stator 42 may be derived based on the resistance of the motor windings.

The VFD temperature sensor 34 measures a temperature (Tvfd) of the VFD 22. The VFD temperature sensor 34 may be located inside the enclosure 20 and/or inside the VFD 22. For example only, the VFD temperature sensor 34 may measure a temperature of a power factor correction (PFC) module in the VFD. For example, the VFD temperature sensor 34 may also measure a temperature of a circuit board temperature in the VFD 22. Additionally, the VFD temperature sensor 34 may measure a temperature of the suction tube 52. The measurements of the VFD temperature sensor 34 may be used as approximations of the ambient temperature.

Figure 5:
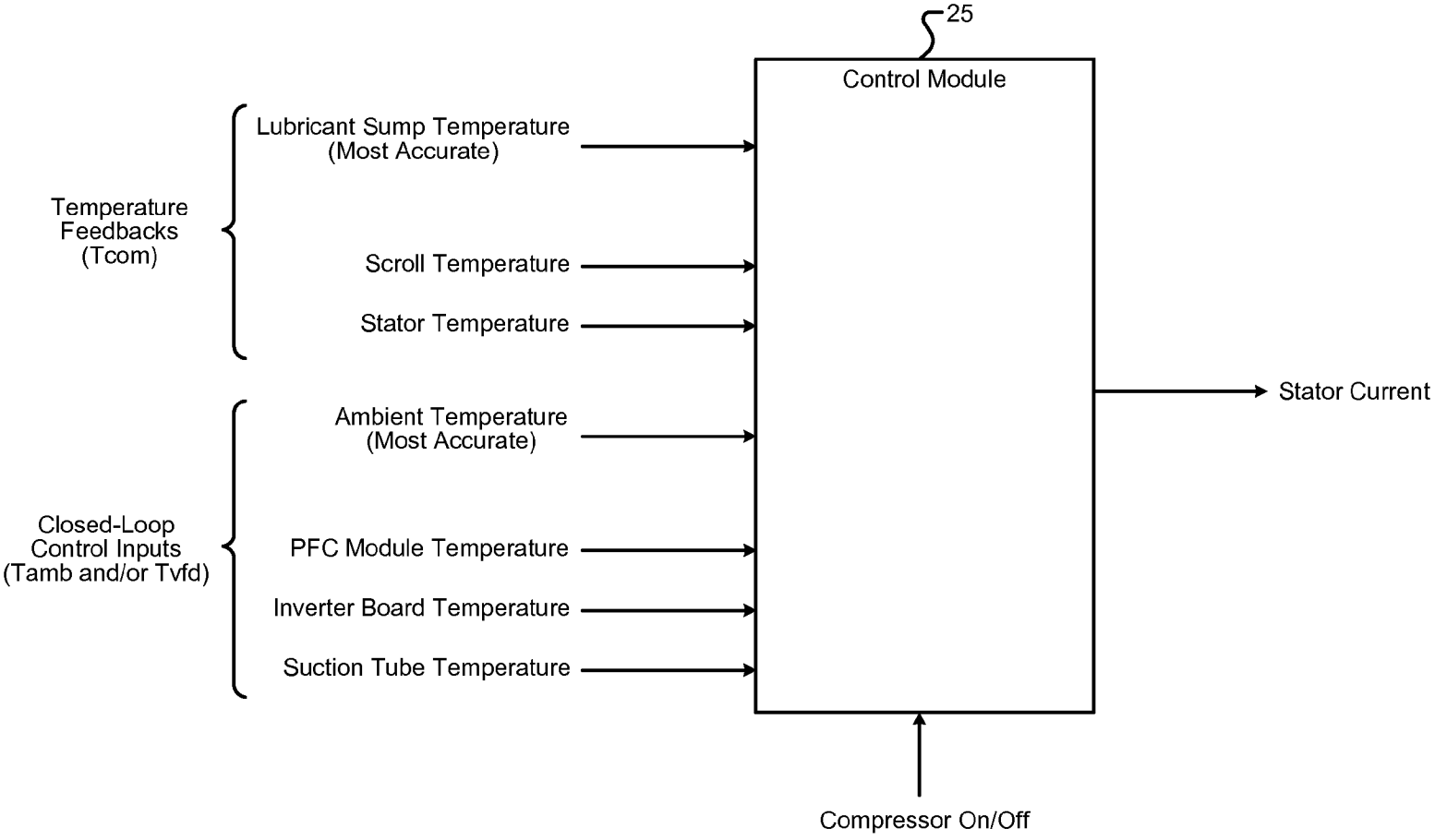
FIG. 5 is a schematic illustration of inputs and outputs of a control module according to the present disclosure.

With reference to FIG. 5, inputs and outputs of the control module 25 are shown in more detail. The control module 25 may perform a closed-loop control of the crankcase temperature. In other words, the control module 25 may control the stator current based on one or more temperature inputs (e.g. Tamb and/or Tvfd) and one or more temperature feedbacks (e.g. Tcom).

The temperature feedbacks may be measured by the compressor temperature sensor 32. For example, the temperature feedbacks may include the lubricant sump temperature, the scroll temperature, and the stator temperature. A most accurate feedback may be the lubricant sump temperature.

The temperature inputs may be measured by the ambient temperature sensor 30 and/or the VFD temperature sensor 34. For example, the temperature inputs may include the ambient temperature, the PFC module temperature, the VFD circuit board temperature, and/or the suction tube temperature. A most accurate input may be the ambient temperature from the ambient temperature sensor 30.

The control module 25 may control the stator current based on one or more of the temperature feedbacks and one or more of the temperature inputs. For example, the control module 25 may perform closed-loop control of the stator current based on the lubricant sump temperature and the ambient temperature. However, the control module 25 may also perform closed-loop control of the stator current based on averages of multiple feedback temperatures and averages of multiple temperature inputs.

Figure 6:
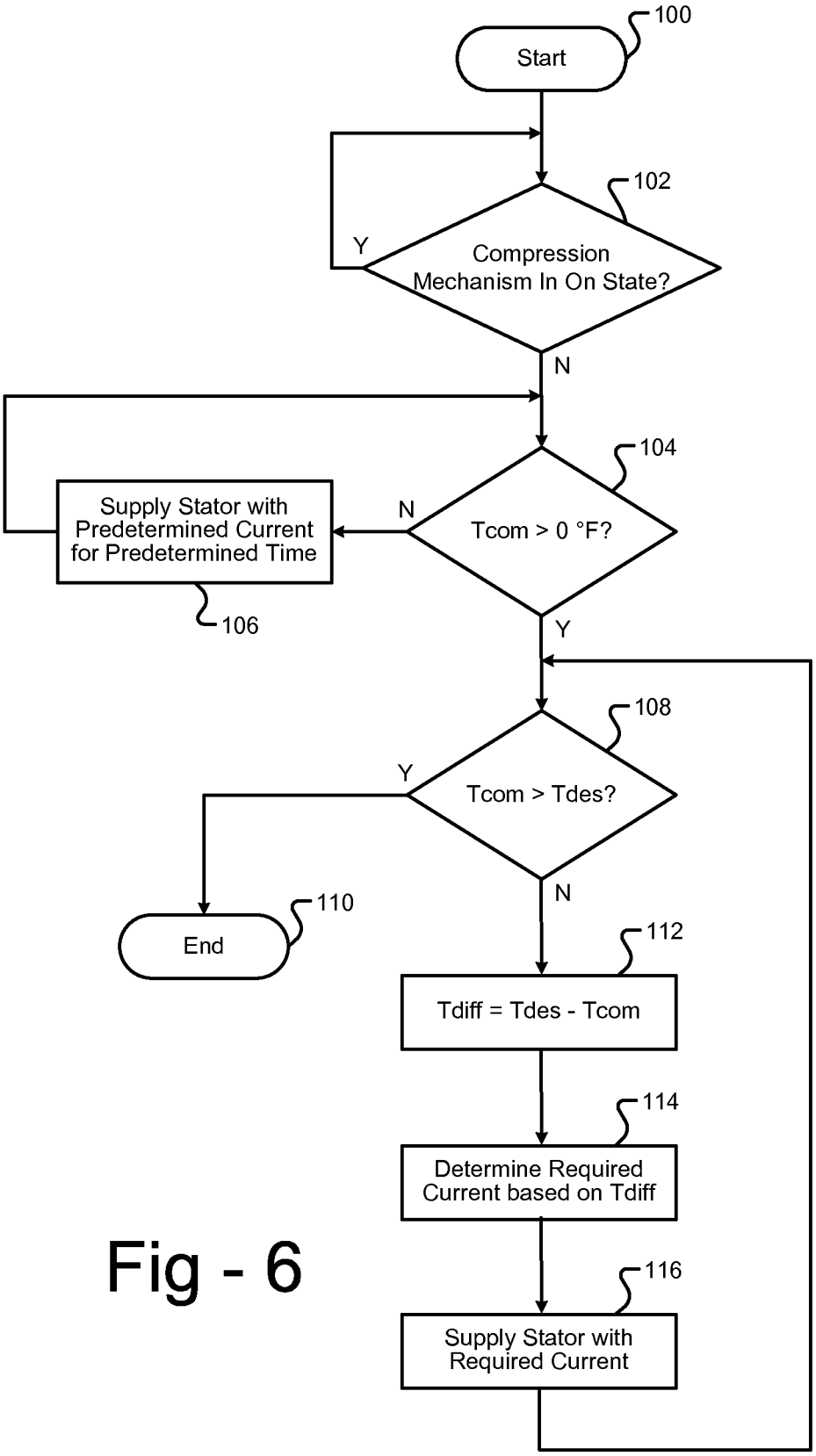
FIG. 6 is a flow diagram of a first method of controlling a lubricant temperature in a compressor.

With reference to FIG. 6, a first method for controlling a lubricant temperature in the compressor 10, using a closed loop control, begins in step 100. In step 102, the control module 25 may determine whether the compressor 10 is running, i.e., whether the compression mechanism is in an on state and being driven by the electric motor and crankshaft to compress refrigerant. If yes, control may return to step 102. If no, control may proceed to step 104. In other words, if the compressor 10 is not running, and the compression mechanism is in an off state and not being driven by the electric motor and crankshaft to compress refrigerant, control may proceed to step 104.

In step 104, the control module 25 may determine whether the compressor temperature Tcom is greater than 0° F. If no, control may proceed to step 106. If yes, control may proceed to step 108. In step 106, the control module 25 may supply the stator 42 with a predetermined amount of current for a predetermined amount of time. In other words, the control module 25 may quickly heat the stator 42 to raise the compressor temperature Tcom above 0° F. to prevent damage to the compressor 10.

In step 108, the control module 25 may determine whether the compressor temperature Tcom is greater than a desired temperature Tdes. For example, the desired temperature Tdes may be a sum of the ambient temperature Tamb and a temperature threshold Tth. Alternatively, for example, the desired temperature Tdes may be a sum of the VFD temperature Tvfd and the temperature threshold Tth. For example only, the temperature threshold Tthr may be 10-20° F. If no, control may proceed to step 112. If yes, no additional heating may be required and control may proceeds to step 110 and end. Alternatively, from step 110 control may wait a predetermined amount of time and then return to step 100. For example, the predetermined amount of time may be 30 minutes.

In step 112, the control module 25 may determine a temperature difference Tdiff. For example only, the temperature difference Tdiff may be the difference between the desired compressor temperature Tdes minus the actual compressor temperature Tcom (e.g. Tdiff=Tdes−Tcom).

In step 114, the control module 25 may determine a required amount of current to heat the stator 42 based on the temperature difference Tdiff. In step 116, the VFD 22 may supply the stator 42 with the required amount of current as determined by the control module 25. In other words, the VFD 22 may vary the voltage delivered to the stator 42 to achieve the required amount of current. Control may then return to step 108 and closed-loop control may continue.

Figure 7:
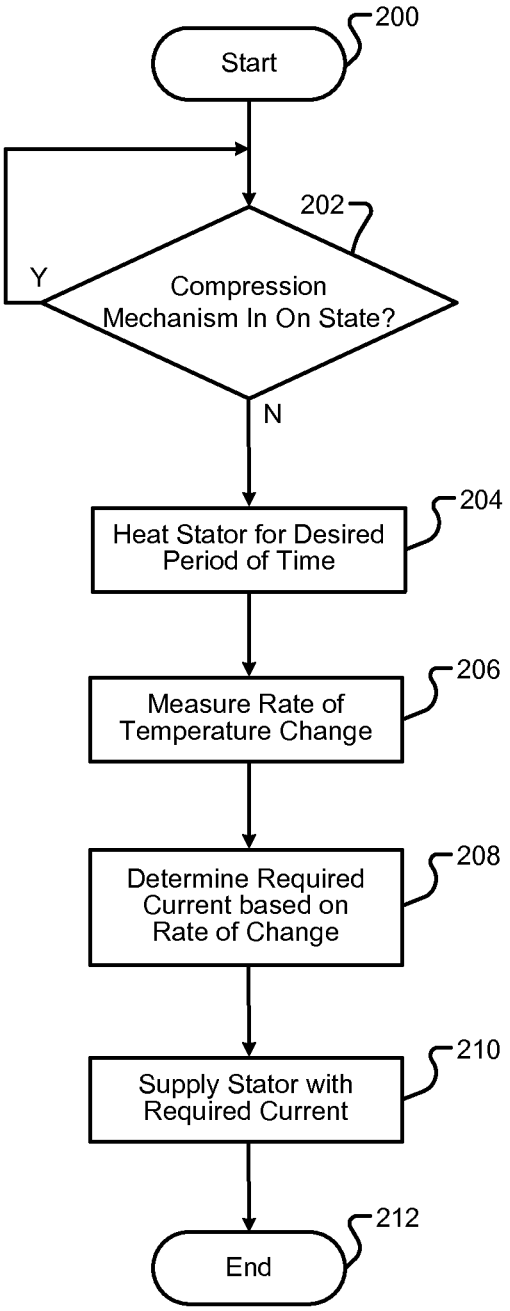
FIG. 7 is a flow diagram of a second method of controlling a lubricant temperature in a compressor.

With reference to FIG. 7, a second method for controlling a lubricant temperature in the compressor 10, using a non-closed loop control, begins in step 200. The second method may relate to maintaining the compressor temperature Tcom at a desired level based on a measured rate of temperature change. Since the second method is not a closed loop control, the second method may be used in conjunction with other heating strategies. For example only, the second method may be used in conjunction with the first method of the present disclosure, described above with respect to FIG. 6.

In step 202, the control module 25 may determine whether the compressor 10 is running, i.e., whether the compression mechanism is in an on state and being driven by the electric motor and crankshaft to compress refrigerant. If yes, control may return to step 202. If no, control may proceed to step 204. In other words, if the compressor 10 is not running, and the compression mechanism is in an off state and not being driven by the electric motor and crankshaft to compress refrigerant, control may proceed to step 204

In step 204, the control module 25 may heat the compressor 10 for a desired period of time. After heating the compressor 10 for the desired period of time, the control module 25 may stop heating the compressor 10.

In step 206, the control module 25 may measure a rate of temperature change based on a drop in compressor temperature Tcom over a predetermined amount of time. For example, the control module 25 may measure the rate of temperature change downward of the stator temperature.

In step 208, the control module 25 may determine a required amount of current to heat a stator of the compressor 10 based on the temperature rate of change. The required amount of current may correspond to maintaining the desired temperature based on current conditions (i.e. ambient temperature).

In step 210, the VFD 22 supplies the stator 42 with the required amount of current as determined by the control module 25. In other words, the VFD 22 may control the voltage delivered to the stator 42 to achieve the required amount of current. Control may then proceed to step 212 and end. Alternatively, from step 212 control may wait a predetermined amount of time and then return to step 200. For example, the predetermined amount of time may be 30 minutes.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A system comprising:

a compressor including a compression mechanism driven by an electric motor in an on state and not driven by the electric motor in an off state;

a variable frequency drive that drives the electric motor in the on state by varying a frequency of a voltage delivered to the electric motor and that supplies electric current to a stator of the electric motor in the off state to heat the compressor;

a compressor temperature sensor that generates a compressor temperature signal corresponding to a compressor temperature;

a control module connected to the variable frequency drive that controls a speed of the electric motor in the on state and that controls the electric current supplied to the stator of the electric motor in the off state;

wherein the control module receives the compressor temperature signal, determines a desired compressor temperature, compares the compressor temperature with the desired compressor temperature, and determines an amount of electric current to supply to the stator in the off state based on the comparison.

2. The system of claim 1, further comprising:

an ambient temperature sensor that generates an ambient temperature signal corresponding to an ambient temperature;

wherein the control module receives the ambient temperature signal and determines the desired compressor temperature based on the ambient temperature.

3. The system of claim 2, wherein the control module determines the desired compressor temperature as a sum of the ambient temperature and a predetermined temperature threshold.

4. The system of claim 3, wherein the predetermined temperature threshold is between ten and twenty degrees Fahrenheit.

5. The system of claim 1, further comprising:

a variable frequency drive temperature sensor that generates a variable frequency drive temperature signal corresponding to a variable frequency drive temperature;

wherein the control module receives the variable frequency drive temperature signal and determines the desired compressor temperature based on the variable frequency drive temperature.

6. The system of claim 5, wherein the control module determines the desired compressor temperature as a sum of the variable frequency drive temperature and a predetermined temperature threshold.

7. The system of claim 6, wherein the predetermined temperature threshold is between ten and twenty degrees Fahrenheit.

8. The system of claim 1, wherein the compressor temperature sensor measures at least one of a temperature of a lubricant in a lubricant sump of the compressor, a temperature of the compression mechanism, and a temperature of a stator of the electric motor.

9. The system of claim 1, wherein the variable frequency drive varies the voltage delivered to the stator to achieve the determined amount of electric current supplied to the stator in the off state.

10. The system of claim 1, wherein the control module determines a temperature difference between the compressor temperature and the desired compressor temperature and determines the amount of electric current to supply to the stator in the off state based on the temperature difference.

11. A method comprising:

controlling, with a control module connected to a variable frequency drive, a speed of an electric motor that drives a compression mechanism of a compressor by varying, with the variable frequency drive, a frequency of a voltage delivered to the electric motor in an on state;

controlling, with the control module, electric current supplied to a stator of the electric motor by the variable frequency drive to heat the stator of the electric motor in an off state, the compression mechanism not being driven by the electric motor in the off state;

receiving, with the control module, a compressor temperature signal generated by a compressor temperature sensor and corresponding to a compressor temperature;

determining, with the control module, a desired compressor temperature;

comparing, with the control module, the compressor temperature with the desired compressor temperature; and determining, with the control module, an amount of electric current to supply to the stator in the off state based on the comparison.

12. The method of claim 11, further comprising:

receiving, with the control module, an ambient temperature signal generated by an ambient temperature sensor and corresponding to an ambient temperature;

wherein the control module determines the desired compressor temperature based on the ambient temperature.

13. The method of claim 12, wherein the control module determines the desired compressor temperature as a sum of the ambient temperature and a predetermined temperature threshold.

14. The method of claim 13, wherein the predetermined temperature threshold is between ten and twenty degrees Fahrenheit.

15. The method of claim 11, further comprising:

receiving, with the control module, a variable frequency drive temperature signal generated by a variable frequency drive temperature sensor and corresponding to a variable frequency drive temperature;

wherein the control module determines the desired compressor temperature based on the variable frequency drive temperature.

16. The method of claim 15, wherein the control module determines the desired compressor temperature as a sum of the variable frequency drive temperature and a predetermined temperature threshold.

17. The method of claim 16, wherein the predetermined temperature threshold is between ten and twenty degrees Fahrenheit.

18. The method of claim 11, wherein the compressor temperature sensor measures at least one of a temperature of a lubricant in a lubricant sump of the compressor, a temperature of the compression mechanism, and a temperature of a stator of the electric motor.

19. The method of claim 11, further comprising varying the voltage delivered to the stator, with the variable frequency drive, to achieve the determined amount of electric current supplied to the stator in the off state.

20. The method of claim 11, wherein the comparing the compressor temperature with the desired compressor temperature includes determining a temperature difference between the compressor temperature and the desired compressor temperature and wherein the determining the amount of electric current to supply to the stator in the off state includes determining the amount of electric current to supply to the state based on the temperature difference.

* * * * *